US009569999B2

(12) United States Patent
Funatsu et al.

(10) Patent No.: US 9,569,999 B2
(45) Date of Patent: Feb. 14, 2017

(54) SIGNAL GENERATION APPARATUS, SIGNAL GENERATION PROGRAM, SIGNAL GENERATION METHOD, AND IMAGE DISPLAY APPARATUS

(71) Applicant: JOLED INC., Tokyo (JP)

(72) Inventors: Yohei Funatsu, Kanagawa (JP); Shoji Araki, Kanagawa (JP)

(73) Assignee: JOLED Inc., Tokyo (JP)

( * ) Notice: Subject to any disclaimer, the term of this patent is extended or adjusted under 35 U.S.C. 154(b) by 154 days.

(21) Appl. No.: 14/508,720

(22) Filed: Oct. 7, 2014

(65) Prior Publication Data

US 2015/0130856 A1 May 14, 2015

(30) Foreign Application Priority Data

Nov. 11, 2013 (JP) ..... 2013-232758

(51) Int. Cl.
*G09G 3/30* (2006.01)
*G09G 5/10* (2006.01)
*G09G 3/34* (2006.01)

(52) U.S. Cl.
CPC *G09G 3/30* (2013.01); *G09G 5/10* (2013.01); *G09G 3/3426* (2013.01); *G09G 2320/0233* (2013.01); *G09G 2320/0626* (2013.01); *G09G 2320/0653* (2013.01); *G09G 2360/16* (2013.01)

(58) Field of Classification Search
None
See application file for complete search history.

(56) References Cited

U.S. PATENT DOCUMENTS 7,038,651 B2 * 5/2006 Nitta ..... G09G 3/3406 345/89
7,903,050 B2 * 3/2011 Kimura ..... G09G 3/20 345/63
8,411,104 B2 * 4/2013 Arashima ..... G09G 3/3648 345/589
8,446,437 B2 * 5/2013 Mori ..... G09G 3/20 345/690
8,982,036 B2 * 3/2015 Kim ..... G09G 3/3426 345/102
9,123,295 B2 * 9/2015 Jeong ..... G09G 3/3233
9,294,748 B2 * 3/2016 Mori ..... G09G 3/20
9,401,110 B2 * 7/2016 Lee ..... G09G 3/3208
(Continued)

FOREIGN PATENT DOCUMENTS

JP 2008-529388 7/2008

*Primary Examiner* — Dismery Mercedes
(74) *Attorney, Agent, or Firm* — Michael Best & Friedrich LLP

(57) ABSTRACT

There is provided a signal generation apparatus for generating an output video signal based on an input video signal provided corresponding to an image to be displayed, the output video signal being a signal for driving an image display section including a display area, the display area including a plurality of pixels arranged in a two-dimensional matrix. At a change of the input video signal from low-brightness display to high-brightness display for a portion of the display area including one or more of the pixels, during a period for the signal change, the output video signal being generated for each of the one or more of the pixels in the portion of the display area to obtain a higher brightness than usual for the portion of the display area.

10 Claims, 9 Drawing Sheets

(56) References Cited

U.S. PATENT DOCUMENTS

| | | | | |
|---|---|---|---|---|
| 2007/0273713 | A1* | 11/2007 | Wubben | G09G 3/3607 345/690 |
| 2012/0038694 | A1* | 2/2012 | Nakanishi | G09G 3/3426 345/694 |
| 2013/0335457 | A1* | 12/2013 | Yano | G09G 3/30 345/690 |

* cited by examiner

SIGNAL GENERATION APPARATUS, SIGNAL GENERATION PROGRAM, SIGNAL GENERATION METHOD, AND IMAGE DISPLAY APPARATUS

CROSS REFERENCE TO RELATED APPLICATIONS

This application claims the benefit of Japanese Priority Patent Application JP 2013-232758 filed Nov. 11, 2013, the entire contents of which are incorporated herein by reference.

BACKGROUND

The present disclosure relates to a signal generation apparatus, a signal generation program, a signal generation method, and an image display apparatus.

Images displayed on a display apparatus have a limited brightness range that is affected by design specifications or others of the display apparatus. The images displayed on the display apparatus thus have a reduced dynamic range of brightness, and thus easily give a viewer an impression as being less real.

For improving such image display, Japanese Unexamined Patent Application Publication (Translation of PCT Application) No. 2009-520241 (hereinafter, referred to as Patent Document 1) describes a technology of selectively increasing a brightness value for any limited bright area in images.

SUMMARY

As described in Patent Document 1, with a higher upper limit set to a brightness value in a specific display portion in images, the images indeed look more real. However, simply setting a higher upper limit to the brightness value causes a problem of image burn-in or others, which are resulted from increased power consumption and degraded display elements.

It is thus desirable to provide a signal generation apparatus, a signal generation program, a signal generation method, and an image display apparatus which can make images look more real and can reduce a degree of image burn-in or other problems caused by increased power consumption and degraded display elements.

According to an embodiment of the present disclosure, there is provided a signal generation apparatus for generating an output video signal based on an input video signal provided corresponding to an image to be displayed, the output video signal being a signal for driving an image display section including a display area, the display area including a plurality of pixels arranged in a two-dimensional matrix.

At a change of the input video signal from low-brightness display to high-brightness display for a portion of the display area including one or more of the pixels, during a period for the signal change, the signal generation apparatus generates the output video signal for each of the one or more pixels in the portion of the display area to obtain a higher brightness than usual for the portion of the display area.

According to an embodiment of the present disclosure, there is provided a signal generation program which, when run on a signal generation apparatus for generating an output video signal based on an input video signal provided corresponding to an image to be displayed, the output video signal being a signal for driving an image display section including a display area, the display area including a plurality of pixels arranged in a two-dimensional matrix, generates, at a change of the input video signal from low-brightness display to high-brightness display for a portion of the display area including one or more of the pixels, during a period for the signal change, the output video signal for each of the one or more of the pixels in the portion of the display area to obtain a higher brightness than usual for the portion of the display area.

According to an embodiment of the present disclosure, there is provided a signal generation method including generating an output video signal based on an input video signal provided corresponding to an image to be displayed, the output video signal being a signal for driving an image display section including a display area, the display area including a plurality of pixels arranged in a two-dimensional matrix.

The method includes, at a change of the input video signal from low-brightness display to high-brightness display for a portion of the display area including one or more of the pixels, during a period for the signal change, generating the output video signal for each of the one or more of the pixels in the portion of the display area to obtain a higher brightness than usual for the portion of the display area.

According to an embodiment of the present disclosure, there is provided an image display apparatus, including:

an image display section including a display area, the display area including a plurality of pixels arranged in a two-dimensional matrix; and a signal generation section configured to generate an output video signal based on an input video signal provided corresponding to an image to be displayed, the output video signal being a signal for driving the image display section, and the signal generation section generating, at a change of the input video signal from low-brightness display to high-brightness display for a portion of the display area including one or more of the pixels, during a period for the signal change, the output video signal for each of the one or more of the pixels in the portion of the display area to obtain a higher brightness than usual for the portion of the display area.

With the signal generation apparatus, the signal generation program, the signal generation method, and the image display apparatus according to the embodiments of the present disclosure, images look more real with a reduced degree of image burn-in or other problems caused by increased power consumption and degraded display elements.

These and other objects, features and advantages of the present disclosure will become more apparent in light of the following detailed description of best mode embodiments thereof, as illustrated in the accompanying drawings.

DETAILED DESCRIPTION OF EMBODIMENT

Figure 1:
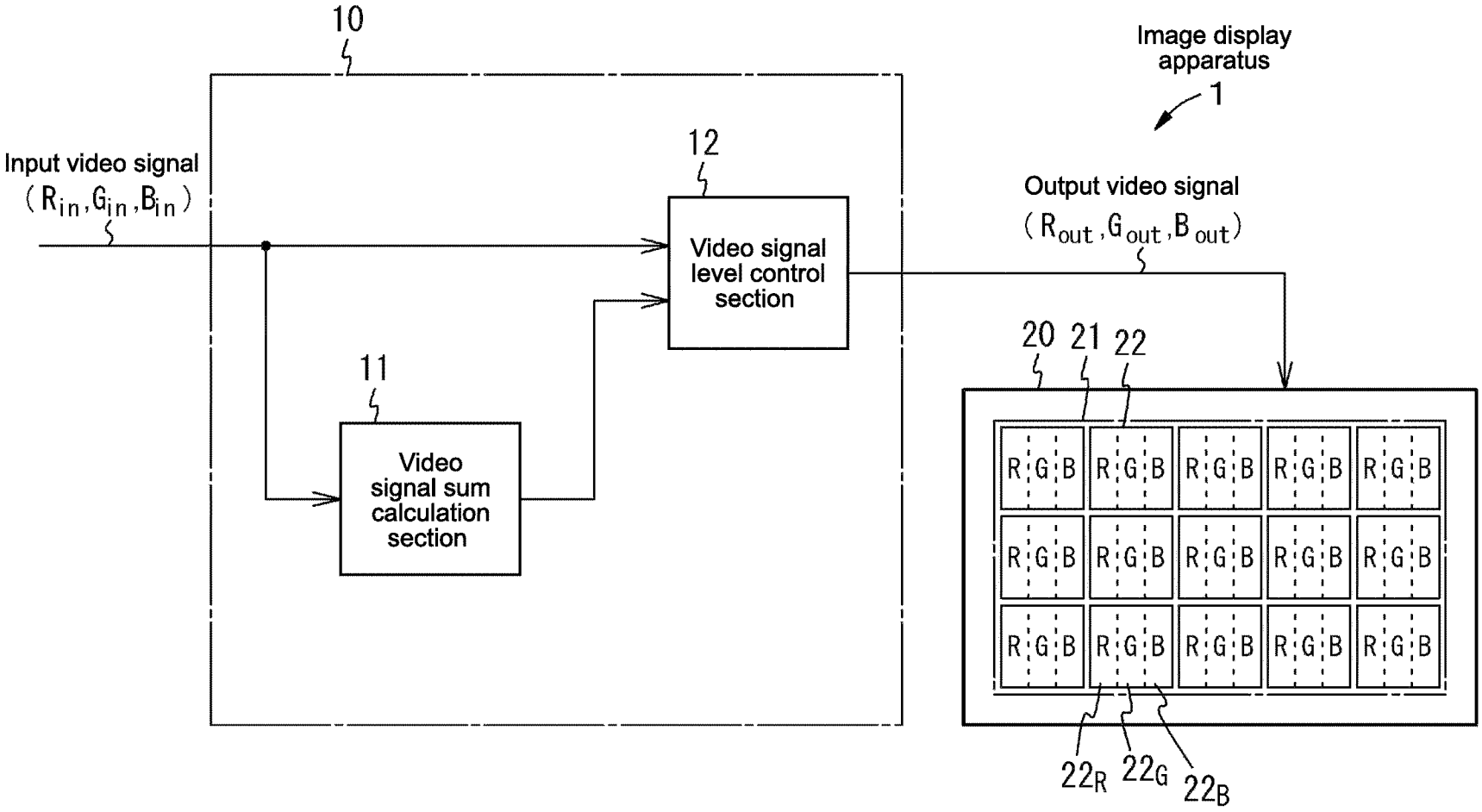
FIG. 1 is a conceptual view of an image display apparatus according to a first embodiment of the present disclosure.

Hereinafter, an embodiment of the present disclosure will be described with reference to the drawings. The present disclosure is not restricted to the embodiment, and various numeric values and materials in the embodiment are illustrative and not restrictive. In the description below, it is understood that any identical components or any components having the same capabilities are under the same reference numeral, and are not described twice. The description is given in the following order.

1. General Description about Present Disclosure, i.e., Signal Generation Apparatus, Signal Generation Program, Signal Generation Method, and Image Display Apparatus 2. First Embodiment, and Others General Description about Present Disclosure, i.e., Signal Generation Apparatus, Signal Generation Program, Signal Generation Method, and Image Display Apparatus In a signal generation apparatus according to an embodiment of the present disclosure, in a signal generation apparatus of running a signal generation program according to an embodiment of the present disclosure, and in a signal generation apparatus for use in an image display apparatus according to an embodiment of the present disclosure (hereinafter, these may be simply and collectively referred to as signal generation apparatus according to an embodiment of the present disclosure), each portion of a display area includes a pixel, and based on an input video signal for the pixel, a signal change is detected from low-brightness display to high-brightness display.

Alternatively, in the signal generation apparatus according to an embodiment of the present disclosure, each portion of a display area may include a plurality of pixels, and based on input video signals corresponding to a part of the pixels, a signal change may be detected from low-brightness display to high-brightness display. In this case, the input video signals corresponding to the part of the pixels may be averaged to be used as a basis for the detection of a signal change from low-brightness display to high-brightness display.

With the signal generation apparatus in the above-mentioned various desirable configurations according to the embodiment of the present disclosure, the value of an output video signal may be calculated by multiplying the value of an input video signal by a gain value. During a period for a signal change, the gain value may be larger than usual for multiplication of the value of an input video signal for each of one or more of pixels in a portion of the display area. In this case, the incoming input video signals may include first to third input video signals. The first input video signal is for displaying the first primary color, the second input video signal is for displaying the second primary color, and the third input video signal is for displaying the third primary color. These first, second, and third input video signals may be each multiplied by the same gain value, thereby generating first, second, and third output video signals as an output video signal. The first output video signal is for driving a first subpixel displaying the first primary color, the second output video signal is for driving a second subpixel displaying the second primary color, and the third output video signal is for driving a third subpixel displaying the third primary color.

With the signal generation apparatus in the above-mentioned various desirable configurations according to the embodiment of the present disclosure, a gain value may be changed for multiplication of the value of an input video signal based on a sum value. The sum value is a value obtained by summing sum step values in the direction of a time axis. The sum step values vary depending on the value of the input video signal. In this case, the sum step value may be the smallest when the value of the input video signal is for image display with the lowest brightness, and may be the largest when the value of the input video signal is for image display with the highest brightness. When the sum step value is a predetermined value or smaller, the sum value may be reset.

With image display sections for use in the embodiment of the present disclosure (hereinafter, these may be simply and collectively referred to as image display section according to an embodiment of the present disclosure), the display mode is not particularly restrictive. The image display section may be suitable for display of moving images or for display of still images. The image display section may be self-luminous like an electroluminescent display apparatus, or may be transparent or reflective like a liquid crystal display apparatus.

The image display section may display images in so-called monochrome or in color. With the image display section displaying images in color, a pixel may include a plurality of subpixels. To be specific, a pixel may include three subpixels, i.e., a red subpixel, a green subpixel, and a blue subpixel. Alternatively, these three subpixels may additionally include one or more subpixels for use as a set, e.g., an additional white subpixel for improved brightness, an additional complementary-color subpixel for a wider color reproduction range, an additional yellow subpixel for a wider color reproduction range, or/and an additional yellow/cyan subpixel for a wider color reproduction range.

The values of the pixels in the image display section are represented by image display resolution of (1920, 1035), (720, 480), (1280, 960) in addition to VGA (640, 480), S-VGA (800, 600), XGA (1024, 768), APRC (1152, 900), S-XGA (1280, 1024), U-XGA (1600, 1200), HD-TV (1920, 1080), and Q-XGA (2048, 1536), for example. However, these values are not restrictive.

The signal generation section and the signal generation apparatus for use in the embodiment of the present disclosure may be configured by an arithmetic circuit or a storage device, for example. These components may be configured using a known circuit element or others. The signal generation section and the signal generation apparatus may operate based on a physical hardware connection(s) or on a program(s). The signal generation section may be implemented as a function in a drive IC (Integrated Circuit), an image processing IC, or others. Herein, the drive IC is used for driving the image display section.

The signal generation section may process incoming input video signals in real time. In some cases, the signal generation section may process the input video signals not in real time. As an example, the signal generation section may successively process data of input video signals stored in a storage section, may store the resulting signal data into the storage section, and may read the signal data in response to a user's request.

Various conditions mentioned in this Specification are satisfied not only when the conditions are accepted in the strict sense but also when the conditions are accepted in the practical sense. That is, the expression of "red" adequately means "red" as long as the color is perceived as red in the practical sense. This is applicable also to other colors. Any design or manufacturing variations are allowed.

First Embodiment

A first embodiment of the present disclosure is about a signal generation apparatus, a signal generation program, a signal generation method, and an image display apparatus.

FIG. 1 is a conceptual view of the image display apparatus in the first embodiment.

An image display apparatus 1 in the first embodiment includes a signal generation section (signal generation apparatus) 10, and an image display section 20. The signal generation section 10 generates an output video signal based on an input video signal coming from the outside, for example. In the image display section 20, first, second, and third subpixels are arranged in a two-dimensional matrix. The first subpixel displays the first primary color, the second subpixel displays the second primary color, and the third subpixel displays the third primary color.

The signal generation section 10 generates an output video signal for each of one or more of pixels in a portion of a display area. During a period for a change of the input video signal from low-brightness display to high-brightness display for the portion of the display area, the signal generation section 10 generates the output video signal so as to obtain the brightness higher than usual for the portion of the display area.

The image display section 20 is configured by a self-luminous display panel including a current-driven light-emitting section, e.g., organic electroluminescent panel.

In the first embodiment, the first, second, and third primary colors are respectively red, green, and blue. In the image display section 20, the first, second, and third subpixels displaying the first, second, and third primary colors are represented by reference numerals of $\mathbf{22}_R$, $\mathbf{22}_G$, and $\mathbf{22}_B$, respectively. Pixels 22 in the image display section 20 are each configured by a set of subpixels, i.e., the first, second, and third subpixels $\mathbf{22}_R$, $\mathbf{22}_G$, and $\mathbf{22}_B$. A display area including the pixels 22 in a matrix is represented by a reference numeral of 21.

The signal generation section 10 is provided with an input video signal from the outside for each pixel in an image for display. For convenience of description, the input video signal provided to the signal generation section 10 from the outside is assumed to be an 8-bit RGB signal, and the output video signal output from the signal generation section 10 is assumed to be a 9-bit RGB signal, for example.

Based on the value of an input video signal provided for each pixel in an image for display, the signal generation section 10 generates an output video signal so as to make the resulting image look more real and to reduce a degree of image burn-in or other problems caused by increased power consumption and degraded display elements. The signal generation section 10 operates based on a signal generation program stored in a storage section that is not shown, and generates an output video signal for each of one or more of pixels in a portion of a display area in such a manner that the portion has brightness higher than usual, during a period for a change of an input video signal(s) from low-brightness display to high-brightness display for the portion of the display area.

An input video signal for display in red is represented by a reference character of $R_{in}$, an input video signal for display in green is represented by a reference character of $G_{in}$, and an input video signal for display in blue is represented by a reference character of $B_{in}$. The input video signals $R_{in}$, $G_{in}$, and $B_{in}$ each take a value from 0 to 255 depending on the expected brightness of an image for display. In this example, the brightness is to be increased with an increase in value of the input video signals. In the description below, the input video signals $R_{in}$, $G_{in}$, and $B_{in}$ are sometimes collectively referred to as "input video signals ($R_{in}$, $G_{in}$, and $B_{in}$), or simply as "input video signals".

Described now are the configuration and operation of the signal generation section 10. The signal generation section 10 includes a video signal sum calculation section 11, and a video signal level control section 12.

The video signal sum calculation section 11 is provided with an input video signal. The video signal level control section 12 is provided with an output from the video signal sum calculation section 11 in addition to the input video signal. Based on these values, the video signal level control section 12 outputs an output video signal.

Figure 2:
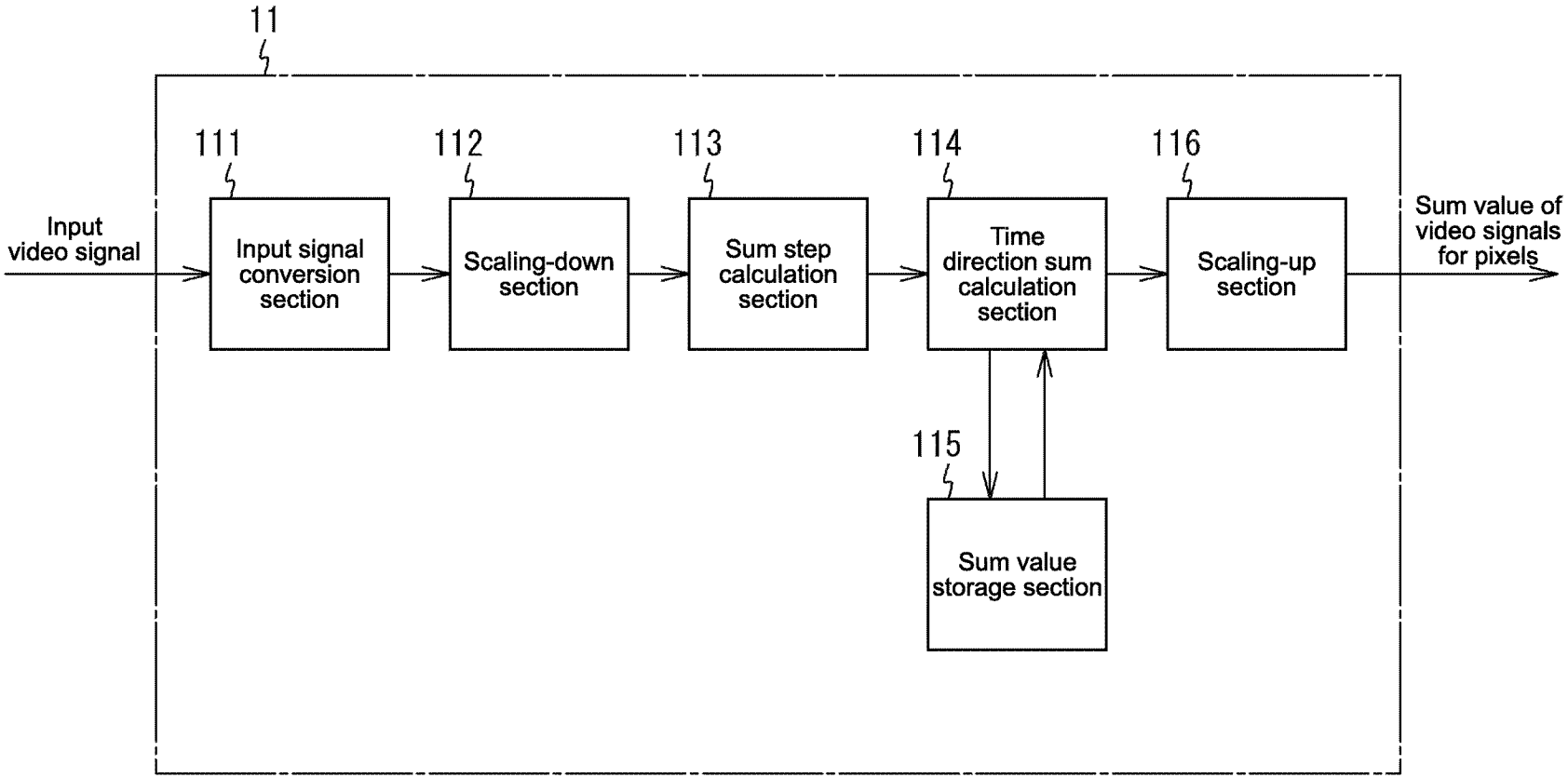
FIG. 2 is a schematic block diagram for illustrating the configuration of a video signal sum calculation section in a signal generation section.

FIG. 2 is a schematic block diagram for illustrating the configuration of the video signal sum calculation section in the signal generation section 10.

The video signal sum calculation section 11 includes an input signal conversion section 111, a scaling-down section 112, a sum step calculation section 113, a time direction sum calculation section 114, a sum value storage section 115, and a scaling-up section 116.

Figure 3:
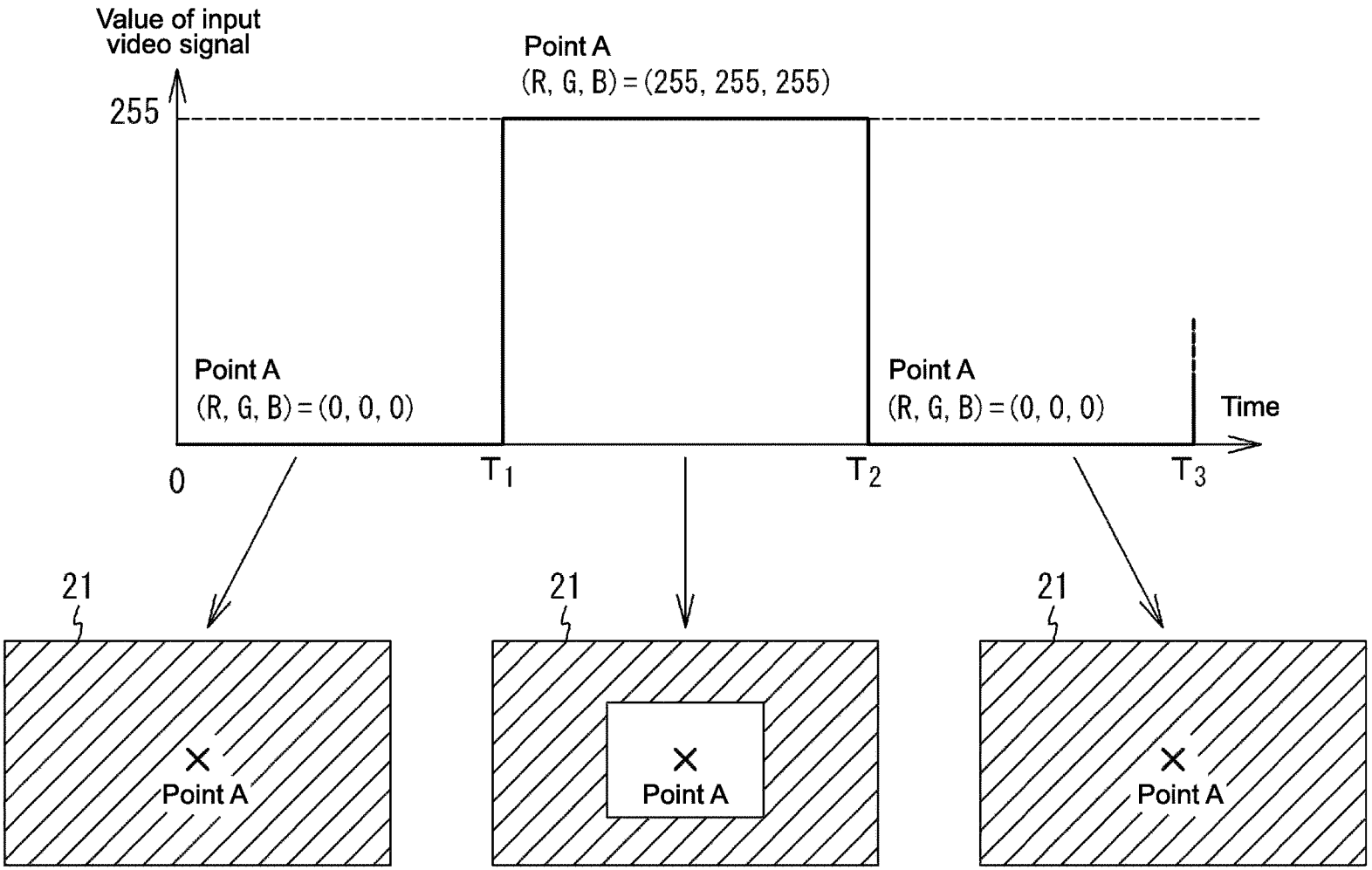
FIG. 3 is a schematic graph illustrating how an input video signal at a point A on a window pattern changes over time when the window pattern is displayed blinking on an image display section.

For convenience of description, an input video signal is assumed to be a signal for displaying a blinking window pattern as shown in FIG. 3. For convenience of illustration, FIG. 3 shows only one illumination period, and two no-illumination periods before and after the illumination period.

Each portion of a display area may be configured by a piece of pixel, and based on an input video signal for the pixel, a signal change may be detected from low-brightness display to high-brightness display. Alternatively, each portion of a display area may be configured by a plurality of pixels, and based on input video signals for a part of the pixels, a signal change may be detected from low-brightness display to high-brightness display. In this example, each portion of a display area is assumed as being configured by a group of eight by eight pixels.

The value of an input video signal at a point A in the window is assumed to be ($R_{in}$, $G_{in}$, $B_{in}$)=(255, 255, 255) during an illumination period (sometimes referred to as white display period), and ($R_{in}$, $G_{in}$, $B_{in}$)=(0, 0, 0) during a no-illumination period (sometimes referred to as black display period). The value of an input video signal for a point outside the window, i.e., in a background portion, is assumed to be ($R_{in}$, $G_{in}$, $B_{in}$)=(0, 0, 0) at all times.

The input signal conversion section 111 of FIG. 2 converts the value of an input video signal into a value of brightness (sometimes represented by a reference character of $L_{out}$), or a value of lightness (sometimes represented by a reference character of $V_{out}$).

For converting the value of an input video signal into a value of brightness, Equation 1 below is used. In Equation 1, coefficients $K_r$, $K_g$, and $K_b$ satisfy $K_r+K_g+K_b$, and generally satisfy $K_r>K_g>K_b$ considering the luminosity factor.

$$L_{out}=K_r*R_{in}+K_g*G_{in}+K_b*B_{in} \quad 1$$

For converting the value of an input video signal into a value of lightness, Equation 2 below is used. In Equation 2, MAX denotes a function that provides the maximum argument.

$$V_{out}=\mathrm{MAX}(R_{in},G_{in},B_{in}) \quad 2$$

For convenience of description, in this example, the value of an input video signal is assumed to be converted into a value of brightness $L_{out}$. When a signal of blinking the window is provided, the input signal conversion section 111 outputs a value of $L_{out}=255$ for the point A of FIG. 3. When a signal of turning off the window is provided, the input signal conversion section 111 outputs a value of $L_{out}=0$ for the point A.

The scaling-down section 112 of FIG. 2 performs a process of scaling down an original image based on the memory size of the sum value storage section 115. This process may be performed by any known method, e.g., simple pixel decimation in a group of pixels including the point A, or averaging of the values of input video signals for the group of pixels.

For convenience of description, the point A is assumed as not being affected by such a scaling-down process. In this case, the output from the scaling-down section 112 is 255.

Figure 4:
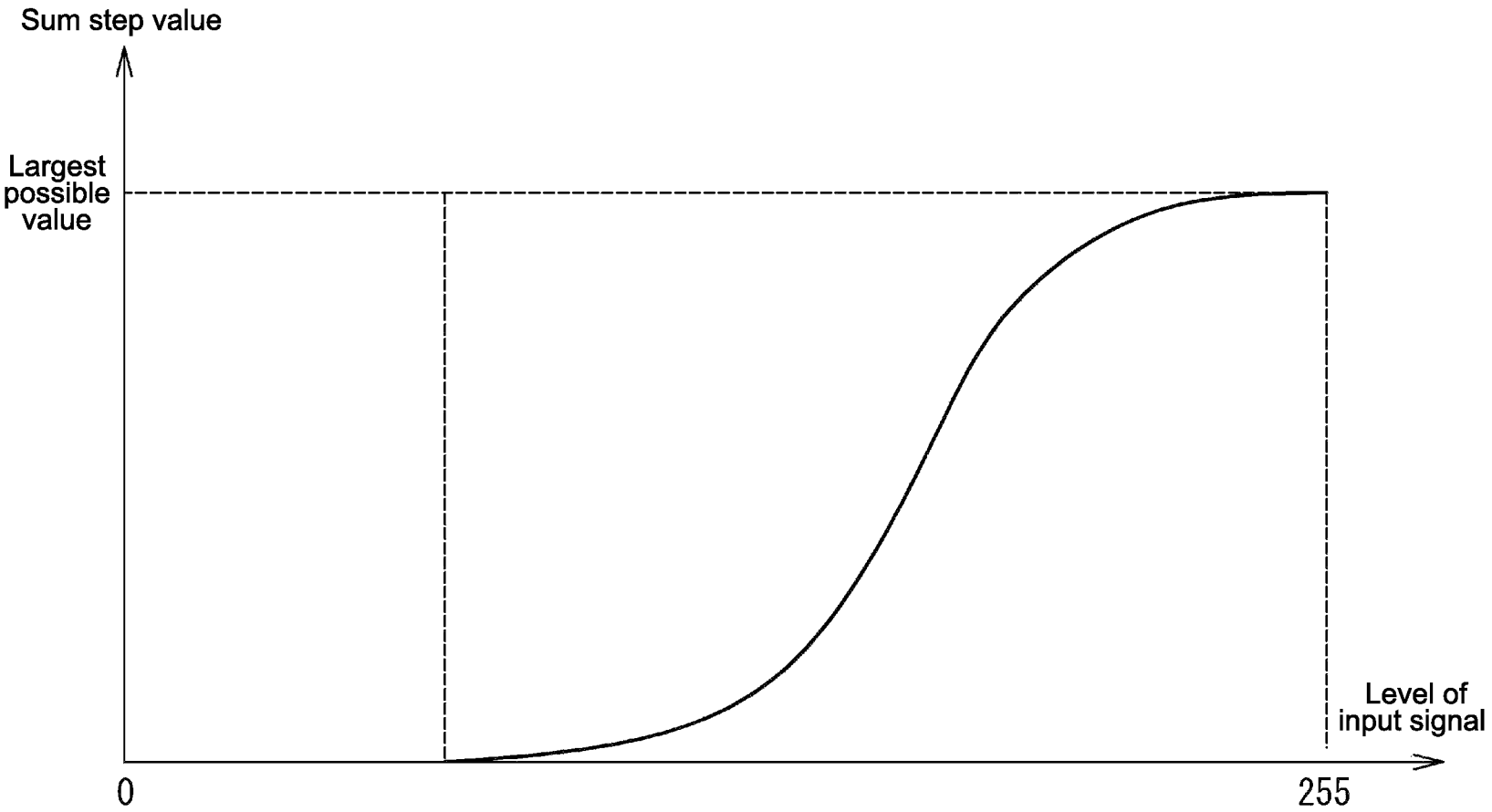
FIG. 4 is a schematic graph for illustrating calculation of a sum step value by a sum step calculation section in a signal generation apparatus.

The sum step calculation section 113 calculates a sum step value based on such characteristics as shown in FIG. 4. The sum step value is so set as to be the smallest when an input video signal is for image display with the lowest brightness, and to be the largest when the input video signal is for image display with the highest brightness. The characteristics of FIG. 4 are given as a weighting function of increasing a sum step value with a larger output from the scaling-down section 112, i.e., with the image being higher in brightness. This function may be given as a look-up table or an arithmetic expression.

Note that, with the characteristics of FIG. 4, the sum step value shows a smooth change in accordance with the level of an input video signal. Alternatively, the sum step value may show a digital change, e.g., the sum step value takes a value of 0 when the signal level is in a range of 0 to 127, and takes the largest possible value when the signal level is in a range of 128 to 255.

In this example, the largest possible value for the sum step value of FIG. 4 (sometimes represented by a reference character of SS) is assumed to be 4. The sum step value SS at the point A of FIG. 3 shows a change of value as below, where t denotes a time.

$$0\le t<T_1:SS=0$$

$$T_1\le t<T_2:SS=4$$

$$T_2\le t<T_3:SS=0$$

The time direction sum calculation section 114 of FIG. 2 performs a process of adding together the sum step value SS and the sum value stored in the sum value storage section 115, or a process of resetting the sum value stored in the sum value storage section 115 corresponding to the input sum step value SS.

The process of adding the values as above may be performed at a time interval that is set as appropriate to specifications. For convenience of description, this time interval is assumed to be set invariably to a period of two frames, but it is also possible that the time interval may be variable depending on the sum value.

The sum value is in a range of 0 to 255, for example. In other words, when the sum value exceeds 255, the value is rounded to 255.

When the sum step value is a predetermined value or smaller, the sum value in storage is reset. In this example, when the sum step value is 0, the sum value is to be reset.

At the point A of FIG. 3, the sum step value is 0 during the black display period. Therefore, the sum step value is reset at all times in the black display period so that the sum value is 0.

Figure 5:
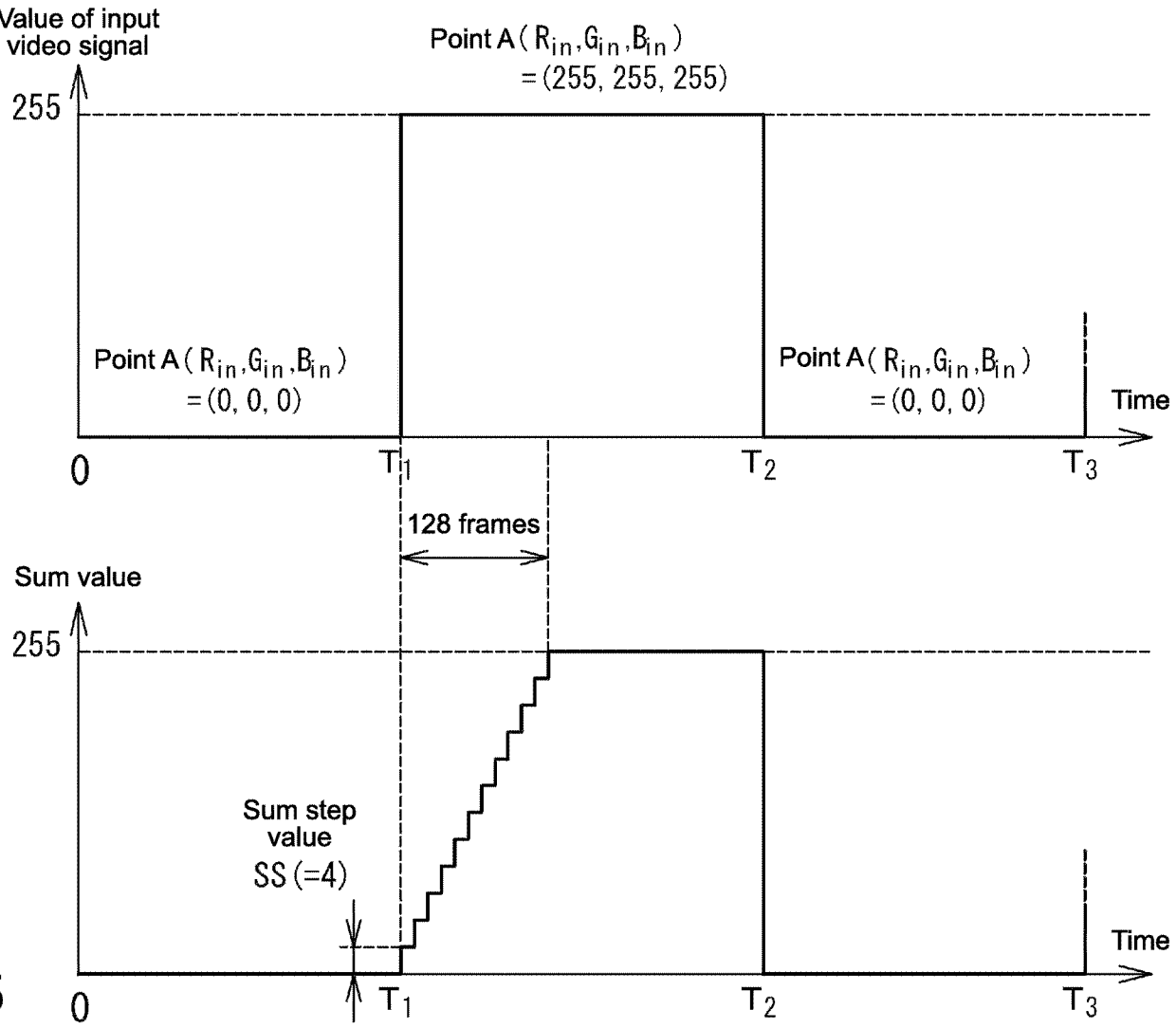
FIG. 5 is a schematic graph for illustrating a change of a sum value.

At Time $T_1$, the window is displayed in white, and the sum value is added with the sum step value SS of 4 in cycles of two frames. This allows detection of a signal change from low-brightness display to high-brightness display based on an input video signal for each of the pixels. Assuming that the window remains white for several seconds, the addition process is performed for 64 times within 128 frames (equivalent to two seconds when 60 frames per second), and the sum value reaches the largest possible value of 255 (refer to FIG. 5).

At Time $T_2$, the window is displayed in black, and the sum step value becomes 0. At this time, the resetting process is performed so that the sum value becomes 0 (refer to FIG. 5).

The scaling-up section 116 of FIG. 2 performs a scaling-up process to obtain an image including pixels equivalent in number to those in the original image. This scaling-up process is performed on the image that has been scaled down following the memory size of the sum value storage section 115. This scaling-up process may be performed by a known method, e.g., copying values of adjacent pixels, or performing linear or nonlinear interpolation between each two pixels in the scaled-down image. Such a scaling-up process obtains a value in a range of 0 to 255 as a sum value of the input video signals.

Described above is the operation of the video signal sum calculation section 11.

Described next is the operation of the video signal level control section 12 of FIG. 1.

Figure 6:
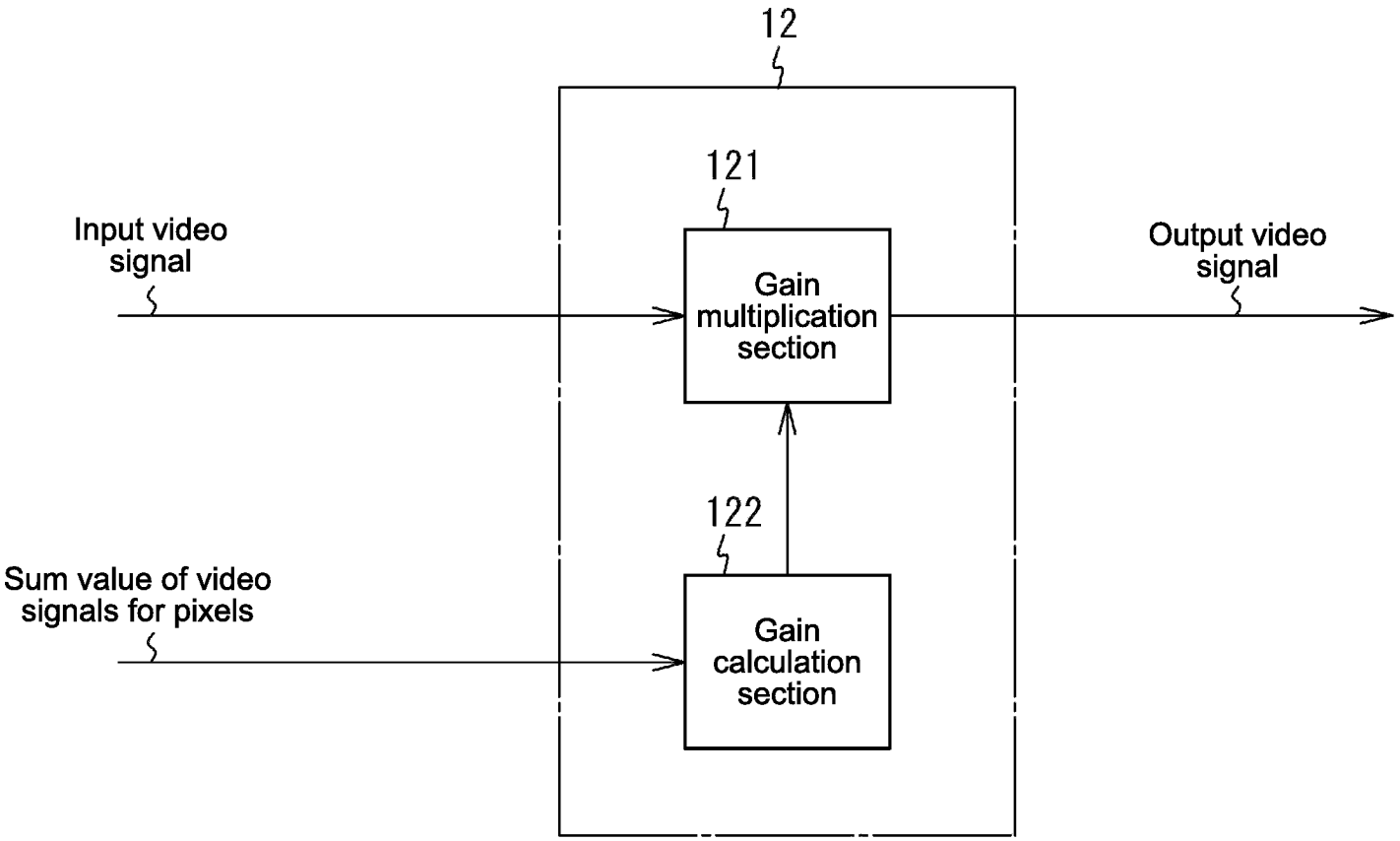
FIG. 6 is a schematic block diagram for illustrating the configuration of a video signal level control section in the signal generation apparatus.

FIG. 6 is a schematic block diagram for illustrating the configuration of the video signal level control section in the signal generation apparatus.

The video signal level control section 12 includes a gain multiplication section 121, and a gain calculation section 122. Described first is the operation of the gain calculation section 122.

Figure 7:
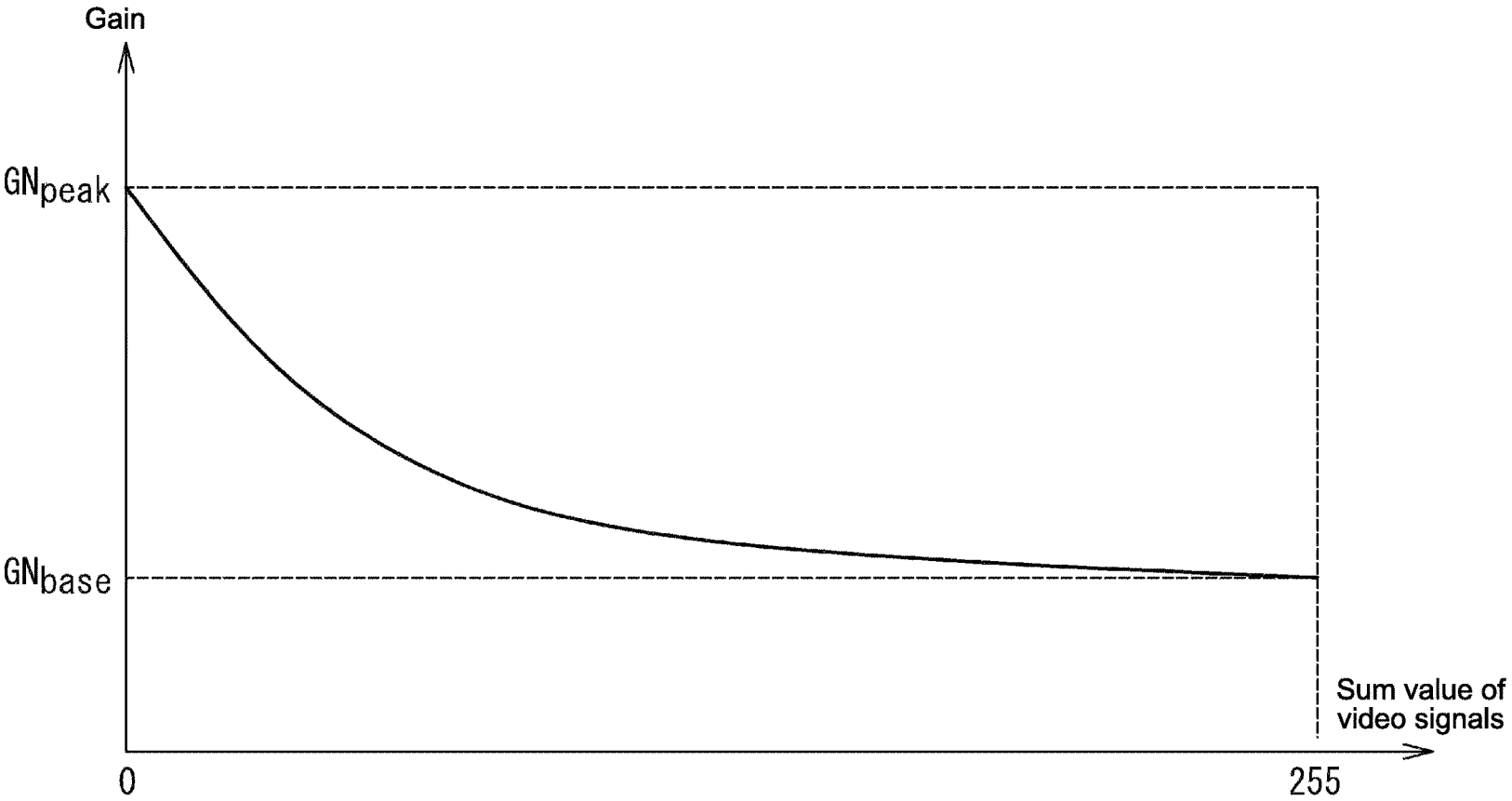
FIG. 7 is a schematic graph for illustrating calculation of a gain value by a gain calculation section in the signal generation apparatus.

An output from the video signal sum calculation section 11, i.e., a sum value of the input video signals, is input to the gain calculation section 122. The gain calculation section 122 then calculates a gain value for the sum value of the video signals in accordance with such characteristics as shown in the graph of FIG. 7. In FIG. 7, a reference character $GN_{peak}$ denotes the largest gain value, and a reference character $GN_{base}$ denotes the smallest gain value, e.g., $GN_{peak}=1.0$, and $GN_{base}=0.5$.

The gain calculation section 122 is provided with a weighting function as a lookup table or an arithmetic expression. With the weighting function, an output of gain value is larger with a smaller sum value of video signals, and an output of gain value is smaller with a larger sum value of video signals. The gain calculation section 122 calculates a gain value corresponding to a sum value of video signals.

At the point A of FIG. 3, the sum value is 0 during the black display period. Therefore, the gain calculation section 122 of FIG. 6 continuously outputs the largest value of $GN_{peak}$ as a gain value for the point A while the time t is in a range of $0 \leq t < T_1$.

Figure 8:
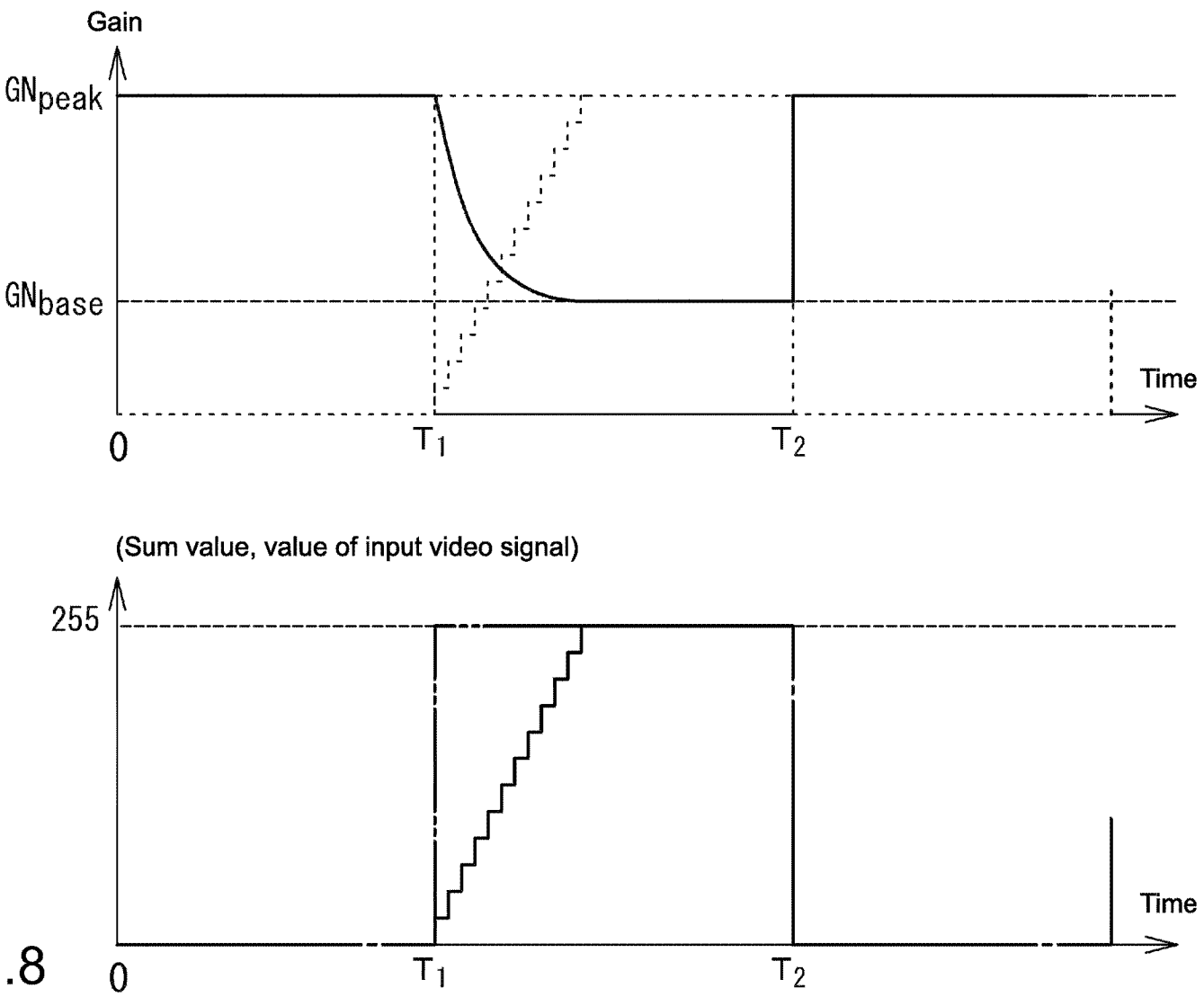
FIG. 8 is a schematic graph for illustrating a correspondence between a sum value/a value of an input video signal and a gain value.

At Time $T_1$, the window is displayed in white. The sum value of the video signals is gradually incremented over time since illumination of the window. Accordingly, the gain value for output is also decreased by degrees. With 128 frames after illumination of the window, the sum value of the video signals reaches the largest possible value of 255, and the gain value for output becomes the smallest value of $GN_{base}$. This state is maintained thereafter while the window is illuminated (refer to FIG. 8). As described above, the gain calculation section 122 operates so as to change a gain value for multiplication of input video signals based on a sum value, which is obtained by summing sum step values corresponding to the values of input video signals in the direction of a time axis.

At Time $T_2$, the window is displayed in black. As described above, the sum step value is 0 during the black display period. Therefore, the sum step value is reset at all times in the black display period so that the sum value is 0. A gain value for output is the largest value of $GN_{peak}$ (refer to FIG. 8).

Described next is the operation of the gain multiplication section 121 of FIG. 6. The gain multiplication section 121 is provided with an input video signal, and the gain value obtained by the gain calculation section 122. The gain multiplication section 121 multiplies the input video signal by the gain value, thereby obtaining an output video signal.

In this example, incoming input video signals ($R_{in}$, $G_{in}$, $B_{in}$) are each multiplied by the same gain value. Therefore, in principle, an image to be displayed shows no change of chromaticity. The values of the input video signals are given by Equations 3, 4, and 5 below, where $GN_{out}$ denotes the gain value provided by the gain calculation section 122, and ($R_{out}$, $G_{out}$, $B_{out}$) denotes output video signals. Herein, the gain value $GN_{out}$ is in a range of 0.5 to 1, for example.

$$R_{out}=GN_{out}*R_{in} \quad 3$$

$$G_{out}=GN_{out}*G_{in} \quad 4$$

$$B_{out}=GN_{out}*B_{in} \quad 5$$

As described above, first, second, and third input video signals are each multiplied by the same gain value to generate output video signals, i.e., first, second, and third output video signals that are respectively for driving first, second, and third subpixels. The first subpixel displays the first primary color, the second subpixel displays the second primary color, and the third subpixel displays the third primary color.

The value of an output video signal is calculated by multiplying the value of an input video signal by a gain value as above. During a period for a change of the input video signal, the gain value may be larger than usual for multiplication of the value of the input video signal for each pixel in a portion of a display area.

Alternatively, for multiplication of the value of an input video signal, a gain value may be assigned a weight corresponding to the value of the input video signal.

Figure 9:
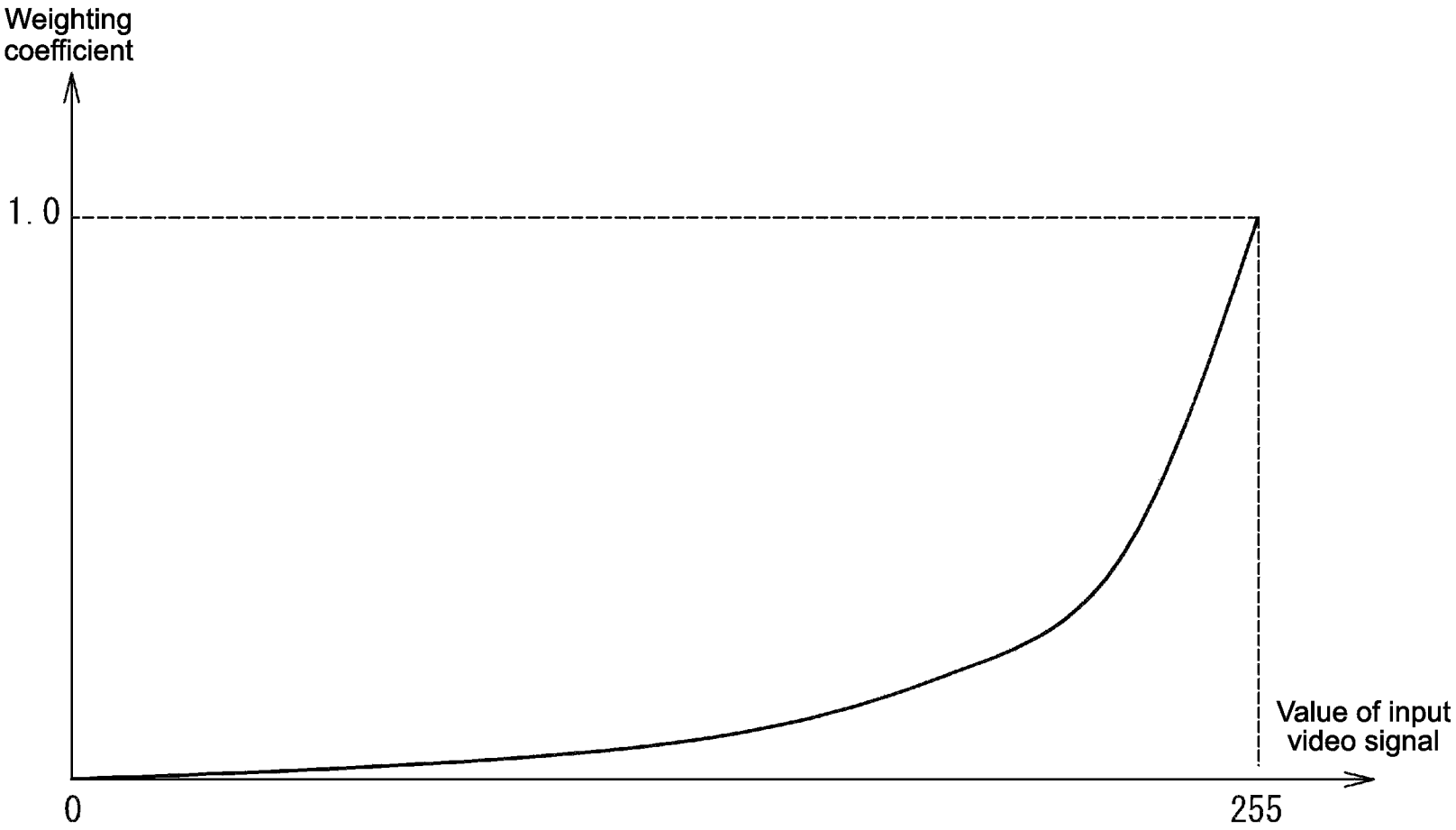
FIG. 9 is a schematic graph illustrating an exemplary weighting function with a coefficient of increasing the gain value with an increase of the value of the input video signal.

FIG. 9 is a schematic graph illustrating an exemplary function with a coefficient of increasing a gain value with an increase in value of an input video signal. The graph shows characteristics of increasing a gain value with a larger value of the input video signal, and produces an effect of further increasing the brightness of high-brightness pixels, i.e., enhancing the brightness. Assuming that a gain value for multiplication of the value of an input video signal is represented by $GN'_{out}$, $GN'_{out}$ is given by Equation 6 below, where a reference character GK denotes the value of a coefficient in FIG. 9.

$$GN'_{out}=1+GK*GN_{out} \quad 6$$

Note here that the reference character GK takes a value in a range of 0 to 1.0, and the reference character $GN'_{out}$ takes a value in a range of 1.0 to 2.0, for example.

According to Equation 6 above, if with low-brightness display, $GN'_{out}=1$ is output irrespective of what sum value is obtained. That is, even if resetting a sum value during low-brightness display causes $GN_{out}=GN_{peak}$, $GN'_{out}=1$ is obtained because GK=0. This allows control over display brightness on the high-brightness side in the time axis direction with no influence on the low-brightness side.

As described above, as to an input video signal for each of one or more of pixels in a portion of a display area, during a period for a change of the input video signal from low-brightness display to high-brightness display, an output video signal is generated in such a manner that the brightness would be higher than usual in the portion of the display area. Such an output video signal is generated for each of the pixels in the portion of the display area.

In this manner, the output video signals are generated so that image glaring or the like may be enhanced, and this makes the image more real. Moreover, this is not the operation that runs high-brightness display all the time, so it is possible to reduce the degree of image burn-in or other problems caused by increased power consumption and degraded display elements.

The present disclosure may be also in the following structures.

(1) A signal generation apparatus for generating an output video signal based on an input video signal provided corresponding to an image to be displayed, the output video signal being a signal for driving an image display section including a display area, the display area including a plurality of pixels arranged in a two-dimensional matrix, and at a change of the input video signal from low-brightness display to high-brightness display for a portion of the display area including one or more of the pixels, during a period for the signal change, the output video signal being generated for each of the one or more of the pixels in the portion of the display area to obtain a higher brightness than usual for the portion of the display area.

(2) The signal generation apparatus according to (1), in which the portion of the display area includes one pixel, and the signal change from low-brightness display to high-brightness display is detected based on the input video signal for the pixel.

(3) The signal generation apparatus according to (1), in which the portion of the display area includes a plurality of pixels, and the signal change from low-brightness display to high-brightness display is detected based on the input video signal and others for a part of the plurality of pixels.

(4) The signal generation apparatus according to (3), in which the signal change from low-brightness display to high-brightness display is detected based on an average of the input video signals for the part of the plurality of pixels.

(5) The signal generation apparatus according to any one of (1) to (4), in which a value of the output video signal is calculated by multiplying a value of the input video signal by a gain value, and during the period for the signal change, the gain value is larger than usual for multiplication of the value of the input video signal provided to each of the one or more of the pixels in the portion of the display area.

(6) The signal generation apparatus according to (5), in which the input video signal includes first, second, and third input video signals, the first input video signal being for displaying a first primary color, the second input video signal being for displaying a second primary color, the third input video signal being for displaying a third primary color, and the first, second, and third input video signals are each multiplied by the same gain value to generate first, second, and third output video signals as the output video signals, the first output video signal being for driving a first subpixel displaying the first primary color, the second output video signal being for driving a second subpixel displaying the second primary color, and the third output video signal being for driving a third subpixel displaying the third primary color.

(7) The signal generation apparatus according to any one of (1) to (6), in which the gain value for multiplication of the value of the input video signal varies based on a sum value, the sum value being obtained by summing a sum step value in a time axis direction, the sum step value being provided corresponding to the value of the input video signal.

(8) The signal generation apparatus according to (7), in which the sum step value varies to be the smallest when the value of the input video signal is for image display with the lowest brightness, and to be the largest when the value of the input video signal is for image display with the highest brightness.

(9) The signal generation apparatus according to (7) or (8), in which when the sum step value is a predetermined value or smaller, the sum value is reset.

(10) A signal generation program which, when run on a signal generation apparatus for generating an output video signal based on an input video signal provided corresponding to an image to be displayed, the output video signal being a signal for driving an image display section including a display area, the display area including a plurality of pixels arranged in a two-dimensional matrix, generates, at a change of the input video signal from low-brightness display to high-brightness display for a portion of the display area including one or more of the pixels, during a period for the signal change, the output video signal for each of the one or more of the pixels in the portion of the display area to obtain a higher brightness than usual for the portion of the display area.

(11) The signal generation program according to (10), in which the portion of the display area includes one pixel, and the signal change from low-brightness display to high-brightness display is detected based on the input video signal for the pixel.

(12) The signal generation program according to (10), in which the portion of the display area includes a plurality of pixels, and the signal change from low-brightness display to high-brightness display is detected based on the input video signal and others for a part of the plurality of pixels.

(13) The signal generation program according to (12), in which the signal change from low-brightness display to high-brightness display is detected based on an average of the input video signals for the part of the plurality of pixels.

(14) The signal generation program according to any one of (10) to (13), in which a value of the output video signal is calculated by multiplying a value of the input video signal by a gain value, and during the period for the signal change, the gain value is larger than usual for multiplication of the value of the input video signal provided to each of the one or more of the pixels in the portion of the display area.

(15) The signal generation program according to (14), in which the input video signal includes first, second, and third input video signals, the first input video signal being for displaying a first primary color, the second input video signal being for displaying a second primary color, the third input video signal being for displaying a third primary color, and the first, second, and third input video signals are each multiplied by the same gain value to generate first, second, and third output video signals as the output video signals, the first output video signal being for driving a first subpixel displaying the first primary color, the second output video signal being for driving a second subpixel displaying the second primary color, and the third output video signal being for driving a third subpixel displaying the third primary color.

(16) The signal generation program according to any one of (10) to (15), in which the gain value for multiplication of the value of the input video signal varies based on a sum value, the sum value being obtained by summing a sum step value in a time axis direction, the sum step value being provided corresponding to the value of the input video signal.

(17) The signal generation program according to (16), in which the sum step value varies to be the smallest when the value of the input video signal is for image display with the lowest brightness, and to be the largest when the value of the input video signal is for image display with the highest brightness.

(18) The signal generation program according to (16) or (17), in which when the sum step value is a predetermined value or smaller, the sum value is reset.

(19) A signal generation method including:

generating an output video signal based on an input video signal provided corresponding to an image to be displayed, the output video signal being a signal for driving an image display section including a display area, the display area including a plurality of pixels arranged in a two-dimensional matrix, and at a change of the input video signal from low-brightness display to high-brightness display for a portion of the display area including one or more of the pixels, during a period for the signal change, generating the output video signal for each of the one or more of the pixels in the portion of the display area to obtain a higher brightness than usual for the portion of the display area.

(20) The signal generation method according to (19), in which the portion of the display area includes one pixel, and the signal change from low-brightness display to high-brightness display is detected based on the input video signal for the pixel.

(21) The signal generation method according to (19), in which the portion of the display area includes a plurality of pixels, and the signal change from low-brightness display to high-brightness display is detected based on the input video signal and others for a part of the plurality of pixels.

(22) The signal generation method according to (21), in which the signal change from low-brightness display to high-brightness display is detected based on an average of the input video signals for the part of the plurality of pixels.

(23) The signal generation method according to any one of (19) to (22), in which a value of the output video signal is calculated by multiplying a value of the input video signal by a gain value, and during the period for the signal change, the gain value is larger than usual for multiplication of the value of the input video signal provided to each of the one or more of the pixels in the portion of the display area.

(24) The signal generation method according to (23), in which the input video signal includes first, second, and third input video signals, the first input video signal being for displaying a first primary color, the second input video signal being for displaying a second primary color, the third input video signal being for displaying a third primary color, and the first, second, and third input video signals are each multiplied by the same gain value to generate first, second, and third output video signals as the output video signals, the first output video signal being for driving a first subpixel displaying the first primary color, the second output video signal being for driving a second subpixel displaying the second primary color, and the third output video signal being for driving a third subpixel displaying the third primary color.

(25) The signal generation method according to any one of (19) to (24), in which the gain value for multiplication of the value of the input video signal varies based on a sum value, the sum value being obtained by summing a sum step value in a time axis direction, the sum step value being provided corresponding to the value of the input video signal.

(26) The signal generation method according to (25), in which the sum step value varies to be the smallest when the value of the input video signal is for image display with the lowest brightness, and to be the largest when the value of the input video signal is for image display with the highest brightness.

(27) The signal generation method according to (25) or (26), in which when the sum step value is a predetermined value or smaller, the sum value is reset.

(28) An image display apparatus, including:

an image display section including a display area, the display area including a plurality of pixels arranged in a two-dimensional matrix; and a signal generation section configured to generate an output video signal based on an input video signal provided corresponding to an image to be displayed, the output video signal being a signal for driving the image display section, and in the signal generation section, at a change of the input video signal from low-brightness display to high-brightness display for a portion of the display area including one or more of the pixels, during a period for the signal change, the output video signal being generated for each of the one or more of the pixels in the portion of the display area to obtain a higher brightness than usual for the portion of the display area.

(29) The image display apparatus according to (28), in which the portion of the display area includes one pixel, and the signal change from low-brightness display to high-brightness display is detected based on the input video signal for the pixel.

(30) The image display apparatus according to (28), in which the portion of the display area includes a plurality of pixels, and the signal change from low-brightness display to high-brightness display is detected based on the input video signal and others for a part of the plurality of pixels.

(31) The image display apparatus according to (30), in which the signal change from low-brightness display to high-brightness display is detected based on an average of the input video signals for the part of the plurality of pixels.

(32) The image display apparatus according to any one of (28) to (31), in which a value of the output video signal is calculated by multiplying a value of the input video signal by a gain value, and during the period for the signal change, the gain value is larger than usual for multiplication of the value of the input video signal provided to each of the one or more of the pixels in the portion of the display area.

(33) The image display apparatus according to (32), in which the input video signal includes first, second, and third input video signals, the first input video signal being for displaying a first primary color, the second input video signal being for displaying a second primary color, the third input video signal being for displaying a third primary color, and the first, second, and third input video signals are each multiplied by the same gain value to generate first, second, and third output video signals as the output video signals, the first output video signal being for driving a first subpixel displaying the first primary color, the second output video signal being for driving a second subpixel displaying the second primary color, and the third output video signal being for driving a third subpixel displaying the third primary color.

(34) The image display apparatus according to any one of (28) to (33), in which the gain value for multiplication of the value of the input video signal varies based on a sum value, the sum value being obtained by summing a sum step value in a time axis direction, the sum step value being provided corresponding to the value of the input video signal.

(35) The image display apparatus according to (34), in which the sum step value varies to be the smallest when the value of the input video signal is for image display with the lowest brightness, and to be the largest when the value of the input video signal is for image display with the highest brightness.

(36) The image display apparatus according to (34) or (35), in which when the sum step value is a predetermined value or smaller, the sum value is reset.

It should be understood by those skilled in the art that various modifications, combinations, sub-combinations and alterations may occur depending on design requirements and other factors insofar as they are within the scope of the appended claims or the equivalents thereof.

What is claimed is:

1. A signal generation apparatus comprising:

a signal generating section, wherein the signal generating section generates an output video signal based on an input video signal provided corresponding to an image to be displayed, the output video signal being a signal for driving an image display section including a display area, the display area including a plurality of pixels arranged in a two-dimensional matrix, wherein at a change of the input video signal from low-brightness display to high-brightness display for a portion of the display area including one or more of the pixels, during a period for the signal change, generating the output video signal for each of the one or more of the pixels in the portion of the display area obtains an increased brightness for the portion of the display area, a video signal sum calculation section, wherein the video signal sum calculation section determines a sum value of the input video signal, the sum value being obtained by summing a sum step value in a time axis direction, the sum step value being provided corresponding to a value of the input video signal, and a video signal level control section, wherein the video signal level control section determines a value of the output video signal by multiplying the sum value of the input video signal by a gain value, and during the period for the signal change, the gain value is increased for multiplication of the value of the input video signal provided to each of the one or more of the pixels in the portion of the display area, wherein the gain value for multiplication of the value of the input video signal varies based on the sum value.

2. The signal generation apparatus according to claim 1, wherein the portion of the display area includes one pixel, and the signal change from low-brightness display to high-brightness display is detected based on the input video signal for the pixel.

3. The signal generation apparatus according to claim 1, wherein the portion of the display area includes a plurality of pixels, and the signal change from low-brightness display to high-brightness display is detected based on the input video signal for a part of the plurality of pixels.

4. The signal generation apparatus according to claim 3, wherein the signal change from low-brightness display to high-brightness display is detected based on an average of the input video signals for the part of the plurality of pixels.

5. The signal generation apparatus according to claim 1, wherein the input video signal includes first, second, and third input video signals, the first input video signal being for displaying a first primary color, the second input video signal being for displaying a second primary color, the third input video signal being for displaying a third primary color, and the first, second, and third input video signals are each multiplied by the same gain value to generate first, second, and third output video signals as the output video signals, the first output video signal being for driving a first subpixel displaying the first primary color, the second output video signal being for driving a second subpixel displaying the second primary color, and the third output video signal being for driving a third subpixel displaying the third primary color.

6. The signal generation apparatus according to claim 1, wherein the sum step value varies to be the smallest when the value of the input video signal is for image display with the lowest brightness, and to be the largest when the value of the input video signal is for image display with the highest brightness.

7. The signal generation apparatus according to claim 1, wherein when the sum step value is a predetermined value or smaller, the sum value is reset.

8. A non-transitory computer readable medium storing a signal generation program that is executable by a processor to perform operations comprising:

generating an output video signal via a signal generation section, based on an input video signal provided corresponding to an image to be displayed, the output video signal being a signal for driving an image display section including a display area, the display area including a plurality of pixels arranged in a two-dimensional matrix, and at a change of the input video signal from low-brightness display to high-brightness display for a portion of the display area including one or more of the pixels, during a period for the signal change, generating the output video signal for each of the one or more of the pixels in the portion of the display area to obtain an increased brightness for the portion of the display area, calculating a sum value of the input video signal, via a video signal sum calculation section, the sum value being obtained by summing a sum step value in a time axis direction, the sum step value being provided corresponding to a value of the input video signal, calculating a value of the output video signal, via a video signal level control section, by multiplying the sum value of the input video signal by a gain value, and during the period for the signal change, the gain value increases for multiplication of the value of the input video signal provided to each of the one or more of the pixels in the portion of the display area, wherein the gain value for multiplication of the value of the input video signal varies based on the sum value.

9. A signal generation method including:

generating an output video signal via a signal generation section, based on an input video signal provided corresponding to an image to be displayed, the output video signal being a signal for driving an image display section including a display area, the display area including a plurality of pixels arranged in a two-dimensional matrix, and at a change of the input video signal from low-brightness display to high-brightness display for a portion of the display area including one or more of the pixels, during a period for the signal change, generating the output video signal for each of the one or more of the pixels in the portion of the display area to obtain an increased brightness for the portion of the display area, calculating a sum value of the input video signal, via a video signal sum calculation section, the sum value being obtained by summing a sum step value in a time axis direction, the sum step value being provided corresponding to a value of the input video signal, calculating a value of the output video signal, via a video signal level control section, by multiplying the sum value of the input video signal by a gain value, and during the period for the signal change, the gain value increases for multiplication of the value of the input video signal provided to each of the one or more of the pixels in the portion of the display area, wherein the gain value for multiplication of the value of the input video signal varies based on the sum value.

10. An image display apparatus, comprising:

an image display section including a display area, the display area including a plurality of pixels arranged in a two-dimensional matrix; and a signal generation section, wherein the signal generation section generates an output video signal based on an input video signal provided corresponding to an image to be displayed, the output video signal being a signal for driving the image display section, and in the signal generation section, wherein at a change of the input video signal from low-brightness display to high-brightness display for a portion of the display area including one or more of the pixels, during a period for the signal change, the signal generation section generates the output video signal for each of the one or more of the pixels in the portion of the display area to obtain an increased brightness for the portion of the display area, a video signal sum calculation section, wherein the video signal sum calculation section determines a sum value of the input video signal, the sum value being obtained by summing a sum step value in a time axis direction, the sum step value being provided corresponding to a value of the input video signal, and a video signal level control section, wherein the video signal level control section determines a value of the output video signal by multiplying the sum value of the input video signal by a gain value, and during the period for the signal change, the gain value is increased for multiplication of the value of the input video signal provided to each of the one or more of the pixels in the portion of the display area, wherein the gain value for multiplication of the value of the input video signal varies based on the sum value.

* * * * *